US005555696A

United States Patent [19]

Morrison, III et al.

[11] Patent Number: 5,555,696

[45] Date of Patent: Sep. 17, 1996

[54] FILAMENT WOUND ARCHITECTURAL COLUMN

[75] Inventors: William S. Morrison, III, 540 Frontage Rd., Suite 3255, Northfield, Ill. 60093; Clint Ashton, Spanish Fork, Utah

[73] Assignee: William S. Morrison, III, Northfield, Ill.

[21] Appl. No.: 407,136

[22] Filed: Mar. 20, 1995

[51] Int. Cl.[6] ..... E04C 3/36

[52] U.S. Cl. ..... 52/737.1; 52/721.2; 52/721.3; 52/721.4; 52/736.1; 52/736.3; 52/737.4; 52/301; 52/309.1; 52/223.4; 52/739.1

[58] Field of Search ..... 52/301, 223.4, 52/309.1, 720.1, 736.1, 736.3, 737.4, 739.1, 721.2, 721.3, 721.4, 737.1, 745.17; 156/173, 175; 248/354.1–354.7; 428/36.3, 377, 398

[56] References Cited

U.S. PATENT DOCUMENTS

| | | | |
|---|---|---|---|
| 163,995 | 6/1875 | Hardy . | |
| 164,979 | 6/1875 | Davenport . | |
| 846,450 | 3/1907 | Brown | 52/737.4 X |
| 1,083,120 | 12/1913 | May . | |
| 1,472,602 | 10/1923 | Lally . | |
| 1,903,907 | 4/1933 | Riemenschneider | 52/301 |
| 2,664,977 | 1/1954 | Starcevich . | |
| 2,870,793 | 1/1959 | Bailey | 52/736.2 X |
| 2,998,110 | 8/1961 | Hutzelman . | |
| 3,429,758 | 2/1969 | Young | 52/736.2 X |
| 3,562,403 | 2/1971 | Monahan et al. . | |
| 3,574,104 | 4/1971 | Medler . | |
| 3,813,098 | 5/1974 | Fischer et al. . | |
| 3,970,495 | 7/1976 | Ashton et al. | 428/36.3 X |
| 3,974,372 | 8/1976 | Cochran | 52/297 X |
| 3,991,532 | 11/1976 | Buxbom . | |
| 4,259,821 | 4/1981 | Bush | 52/309.1 |
| 4,312,162 | 1/1982 | Medney . | |
| 4,381,960 | 5/1983 | Pinter et al. | 428/377 X |
| 4,617,217 | 10/1986 | Michaud-Soret . | |
| 4,641,467 | 2/1987 | Dupuis, Jr. . | |
| 4,769,967 | 9/1988 | Bourrieres . | |
| 4,851,065 | 7/1989 | Curtz | 428/36.3 X |
| 4,912,901 | 4/1990 | Jerry . | |
| 5,218,810 | 6/1993 | Isley, Jr. . | |
| 5,327,694 | 7/1994 | Gamel et al. . | |
| 5,339,594 | 8/1994 | Ventura-Berti . | |

OTHER PUBLICATIONS

Architectural Columns by Hartmann–Sanders, Jul. 1986.

*Primary Examiner*—Carl D. Friedman
*Assistant Examiner*—Christopher Todd Kent
*Attorney, Agent, or Firm*—Thorpe, North & Western

[57] ABSTRACT

A traditional architectural column support. A one-piece unitary column body is hollow and tubular, and is comprised of a fiber-reinforced low-grade polyester system. The column body tapers radially inwardly from the lower third of the body to the upper end thereof in the manner of traditional architectural design. The tubular walls of the column body are exceptionally thin and capable of resisting significant architectural axial load distributions.

15 Claims, 1 Drawing Sheet

FILAMENT WOUND ARCHITECTURAL COLUMN

BACKGROUND OF THE INVENTION

1. Field of the Invention

The present invention relates generally to columns used as structural support in buildings. More particularly, it concerns a filament wound composite architectural column having thin tubular walls with axial load bearing capacity.

2. The Background Art

Until now, fiber-reinforced composite structures involving low-grade bonding agents have not generally been used as load-bearing structural supports. Although fiber-reinforced composites are known to provide excellent resistance to tensile and bending loads, structural compression-loaded supports, such as architectural columns, have been generally confined to reinforced concrete, steel, and large timbers.

There has been a clear pattern in the art to confine application of fiber-reinforced composite materials to articles subject to either tensile or bending loads. For example, composite materials have been used to make ropes (U.S. Pat. No. 4,257,309, issued on Mar. 24, 1981 to Dunahoo), bending spring supports (U.S. Pat. No. 5,368,358, issued on Nov. 29, 1994 to Christensen) tubular members for use as golf shafts, hang gliders spars and the like (U.S. Pat. No. 5,261,980, issued on Nov. 16, 1993 to Pearce), and even utility poles for supporting electric power transmission lines (U.S. Pat. No. 4,769,967, issued on Sep. 13, 1988 to Bourrieres). However, these and other composite articles are subject mainly to flexural and tensile stress and not to significant axial compressive stress.

Although applications involving fiber-reinforced composite materials continue to expand, composites appear to remain confined in their use to resisting bending and tensile loads but not direct axial loads, or as a combination with steel or concrete. The thinking in the field of structural compression members has been that the higher-density materials are necessary to provide the compressive strength needed in structural columns. For example, although U.S. Pat. No. 5,218,810 (issued on Jun. 15, 1993 to Isley, Jr.) teaches the use of composites to produce a structural column, the composite material is limited in use as a fabric reinforcement layer surrounding a reinforced concrete column. Further, the Isley patent teaches application of the composite reinforcement "to increase the column's resistance to structural failure when subjected to asymmetric loading" (col. 2, lines 16–18), suggesting that the composite reinforcement is contemplated to provide resistance to flexure stress and not to direct axial loading.

It is known to manufacture structural columns in accordance with traditional architectural column design. Ionic and Doric orders of architectural column design have been employed to provide a tapered design to vertical columns. Tapered ornamental column supports have evolved in some aspects of their design but not in terms of the core materials used for their manufacture. For example, U.S. Pat. No. 5,327,694 (issued on Jul. 12, 1994 to Gamel et al.) discloses a tapered ornamental column comprising a tubular member made from cardboard and urethane foam, but the tubular member surrounds a reinforced concrete core member which bears the applied loads. Architectural columns have generally comprised solid, nontubular core members made from concrete or steel.

In view of the clear trend to favor use of composites for applications as members or to members in tension or bending, it is doubtful that others have sought to make structural columns from composite materials, especially those involving low-grade polyester systems. Those having ordinary skill in the field of columns are even less likely to contemplate a thin wall, tubular composite architectural column design, especially in view of the centuries-old tendency to build structural columns from concrete or steel.

OBJECTS AND SUMMARY OF THE INVENTION

It is therefore an object of the present invention to provide a traditional architectural column design in the form of a fiber-reinforced composite tubular member.

It is an additional object of the invention, in accordance with one aspect thereof, to provide such an architectural column having exceptionally thin tubular walls.

It is another object of the invention, in accordance with one aspect thereof, to provide such an architectural column capable of resisting significant architectural axial load distributions.

The above objects and others not specifically recited are realized in a specific illustrative embodiment of a traditional architectural column support. A one-piece unitary column body is hollow and tubular, and is comprised of a fiber-reinforced, low-grade polyester system. The column body tapers radially inwardly from the lower third of the body to the upper end thereof in the manner of traditional architectural design. The tubular walls of the column body are exceptionally thin and capable of resisting significant architectural axial load distributions.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
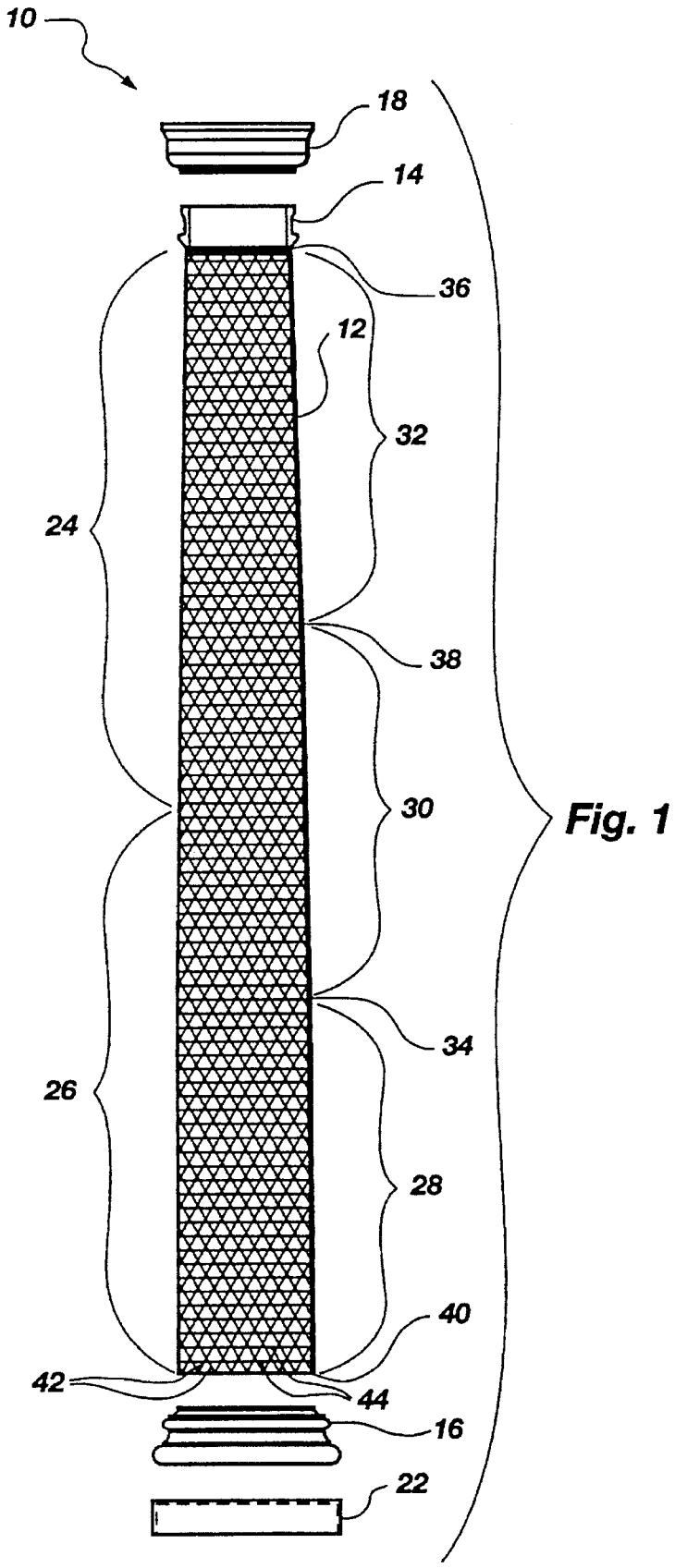
FIG. 1 is an exploded side view of a fiber-reinforced architectural column support, made in accordance with the principles of the present invention.
Figure 2:
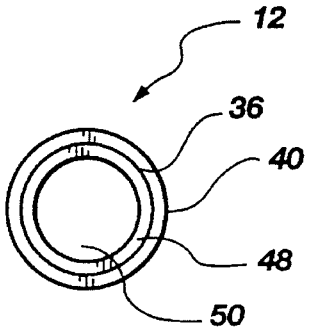
FIG. 2 is a top view of the tubular column body of the column support illustrated in FIG. 1.

Referring now to FIGS. 1–2, there is shown a column support designated generally at 10, made in accordance with the principles of the present invention. The column support 10 includes a one-piece unitary column body 12, a neck 14, a base 16, a cap 18 and a plinth 22.

The column body 12 includes upper and lower halves designated at brackets 24 and 26, respectively, bounded by upper and lower opposing ends 36 and 40, respectively. The column body 12 also includes a lower section or third 28, a middle section or third 30 and an upper section or third 32, wherein a first entasis point 34 separates the lower and middle third sections and a second entasis point 38 separates the middle and upper third sections.

The column body 12 provides axial load bearing support and is tapered, preferably in accordance with Greco-Roman architectural column design. For example, it is preferred that a lower third 28 of the column body 12 be characterized by an absence of substantial taper, or perhaps a slight draw at the most. A middle third 30 and an upper third 32 include exterior surfaces which are preferably tapered by a continuous radially inward taper extending from a first entasis point 34 to an upper end 36 such that the middle third 30 is characterized by one-third of the total taper and the upper third 32 is characterized by two-thirds of the total taper. However, the specific proportions of taper may vary. It is therefore envisioned to define the column body 12 as conforming to an architectural column in which most of the tapering occurs in the upper half 24 of the column body 12.

The column body 12 is made by generally known methods of filament winding, preferably employing a single continuous strand of fiber. The fiber is preferably wound in a helical fashion as shown at 42, followed or preceded by circumferential windings shown at 44. The fiber is preferably an electrical-grade glass fiber, embedded with a low-grade polyester resin system and cured in a manner known to those skilled in the field to form the body 12 as a tubular member surrounding empty space 50 as shown most clearly in FIG. 2. Other suitable fiber-reinforced bonding agents may be used to make the invention. It is preferred that the electrical grade glass fibers comprise an amount within a range of approximately fifty percent to sixty-five percent of the filament-wound composite of fiber-reinforced bonding agent.

The radially inward taper is apparent from a careful inspection of FIG. 1, and is preferably continuous such that a width of the upper end 36 of the column body 12 is less than a width of the lower end 40 by an amount within a range of approximately one-tenth to one-fourth of the width of said lower end 40. For example, the radially inward taper could be substantially in accordance with an historic Ionic order of column design in that the width of the upper end 36 of the column body 12 is less than the width of the lower end 40 by an amount of approximately one-sixth of the width of said lower end 40. Alternatively, the radially inward taper could be substantially in accordance with an historic Doric order of column design in that the width of the upper end 36 is less than the width of the lower end 40 by an amount of approximately one-fifth of the width of said lower end 40.

Although the first and second entasis points 34 and 38 preferably define the column body 12 into thirds, the exact location of the entasis points may vary. It is therefore envisioned to define the column body 12 such that the distance between the lower end 40 and the first entasis point 34 is within a range of approximately twenty-three percent to forty-three percent of the length of the column body 12, and wherein the distance between the lower end 40 and the second entasis point 38 is within a range of approximately fifty-six percent to seventy-six percent of the length of the column body 12, wherein the radially inward taper varies in degree such that the lower section 28 is characterized by an absence of substantial taper, the middle section 30 is characterized by approximately one-third of the total taper, and the upper section 32 is characterized by approximately two-thirds of the total taper.

The column body 12 includes tubular walls 48 of substantially uniform thickness. The tubular walls 48 have a thickness within a range of approximately 1/32 of an inch to 1/4 of an inch and are configured to bear significant architectural axial load distributions applied thereto without failure of the composite material. The term "failure" as used herein refers to any action that prevents the tubular body 12 from fulfilling the function for which it was designed. For example, a structural member may undergo failure by yielding as characterized by plastic deformation wherein stress within the member exceeds its elastic limit, or failure by fracture as characterized by sudden breakage or progressive fatigue. The phrase "architectural axial load distribution" as used herein shall refer simply to compressive-axial loads as such are known to be applied to architectural columns.

Test models of the tubular column body 12 have been tested and found capable of bearing significant axial load distributions without failure of the composite material. The results of applicants' testing are quite surprising: thin-walled filament wound tubular columns constructed in the manner of the column body 12 were found to resist significant axial load distributions without failure of the material. For example, a test model having a length of four feet and a twelve-inch diameter resisted 55,000 psi (pounds per square inch) prior to failure of the material. A 7½-foot model having a twelve inch diameter was first tested with the neck 14 secured thereon, after which the neck 14 was cut off and the model tested again and resisted 48,900 psi prior to failure. From the results of applicants' testing, it is reasonable to conclude that column members constructed in accordance with the column body 12 at lengths sufficient for use in buildings will resist architectural axial load distributions of at least 45,000 psi. Thus, the column body 12 at substantially any useful length will resist axial load distributions of standard minimum 6,000 psi, or with a factor of safety of two for 12,000 psi, or with a factor of safety of four for 24,000 psi, and even in excess of 45,000 psi.

A further surprising result of applicants' testing is that failure in one of the testing models occurred in the form of failure by fracture of only a narrow ring of material near the upper end of perhaps 1/4 inch in length, with the remainder of the testing model remaining sound. The testing model continued to resist significant amounts of axial loading even after this occurrence of failure by fracture of the small upper portion.

In accordance with the principles of the present invention, a preferred method of manufacturing a structural support column comprises the step of:

(a) selecting a mandrel having desired dimensions;

(b) applying a combination of reinforcing fiber and thermosetting resin to the mandrel as part of a filament winding process;

(c) repeating step (b) until a one-piece unitary column body is formed as having upper and lower halves bounded by upper and lower opposing ends, respectively, such that said column body comprises hollow and tubular walls having an exterior surface which tapers radially inwardly from a wider portion thereof to the upper end in a manner conforming to an architectural column in which most of the tapering occurs in the upper half of the column body.

The method set forth above could be augmented with additional steps consistent with the subject matter contained herein. For example, step (c) above may further comprise repeating step (b) until the tubular walls have a thickness within a range of approximately 1/32 of an inch to 1/4 of an inch and are configured to bear architectural axial load distributions applied thereto without failure of the composite.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A structural support column comprising:

a one-piece unitary architectural column body having upper and lower halves bounded by upper and lower opposing ends, respectively, said column body being hollow and having tubular sidewalls comprised of a filament-wound composite of fiber-reinforced bonding agent and being less than ½ inch in thickness, wherein the column body tapers radially inwardly from a wider portion thereof to the upper end thereof in a manner conforming to an architectural column in which most of the tapering occurs in the upper half to the column body, wherein said tubular sidewalls are adapted to bear architectural axial load distributions of at least 6,000 psi applied thereto without failure of the composite.

2. The structural support column as defined in claim 1, wherein the radially inward taper is continuous such that a width of the upper end of the column body is less than a width of the lower end of the column body by an amount within a range of approximately one-tenth to one-fourth of the width of said lower end.

3. The structural support column as defined in claim 2, wherein the radially inward taper is substantially in accordance with an historic Ionic order of column design in that the width of the upper end of the column body is less than the width of the lower end of the column body by an amount of approximately one-sixth of the width of said lower end.

4. The structural support column as defined in claim 2, wherein the radially inward taper is substantially in accordance with an historic Doric order of column design in that the width of the upper end of the column body is less than the width of the lower end of the column body by an amount of approximately one-fifth of the width of said lower end.

5. The structural support column as defined in claim 2, wherein the radially inward taper defines consecutive lower, middle and upper sections of the column body such that the lower section extends along the column body from the lower end to a first entasis point, the middle section extends along the column body from the first entasis point to a second entasis point, and the upper section extends along the column body from the second entasis point to the upper end of the column, wherein the distance between the lower end and the first entasis point is within a range of approximately twenty-three percent to forty-three percent of the length of the column body, and wherein the distance between the lower end and the second entasis point is within a range of approximately fifty-six percent to seventy-six percent of the length of the column body, wherein the radially inward taper varies in degree such that the lower section is characterized by an absence of substantial taper, the middle section is characterized by approximately one-third of the total taper, and the upper section is characterized by approximately two-thirds of the total taper.

6. The structural support column as defined in claim 1, wherein the tubular sidewalls have a thickness within a range of approximately 1/32 of an inch to ¼ of an inch and are configured to bear architectural axial load distributions applied thereto without failure of the composite.

7. The structural support column as defined in claim 1, wherein the filament-wound composite of fiber-reinforced bonding agent comprises electrical-grade glass fibers embedded within a low grade polyester system.

8. The structural support column as defined in claim 7, wherein the electrical grade glass fibers comprise an amount within a range of approximately fifty percent to sixty-five percent of the filament-wound composite of fiber-reinforced bonding agent.

9. A structural support column comprising:

a one-piece unitary architectural column body having upper and lower opposing ends, said column body being hollow and tubular so as to form tubular walls and being comprised of a filament-wound composite of fiber-reinforced bonding agent, wherein the tubular walls have a thickness within a range of approximately 1/32 of an inch to ¼ of an inch and are configured to bear architectural axial load distributions applied thereto without failure of the composite, wherein said tubural walls are configured to bear architectural axial load distributions of at least 6,000 psi applied thereto without failure of the composite.

10. The structural support column as defined in claim 9, wherein the tubular walls of the column body are configured to bear architectural axial load distributions of at least 12,000 psi applied thereto without failure of the composite.

11. The structural support column as defined in claim 9, wherein the tubular walls of the column body are configured to bear architectural axial load distributions of at least 45,000 psi applied thereto without failure of the composite.

12. The structural support column as defined in claim 9, wherein the column body tapers radially inwardly from a wider portion thereof to the upper end thereof in a manner similar to a traditional architectural column in that most of the tapering occurs in the upper half of the column body.

13. The structural support column as defined in claim 12 wherein the radially inward taper is continuous such that a width of the upper end of the column body is less than a width of the lower end of the column body by an amount within a range of approximately one-tenth to one-fourth of the width of said lower end.

14. The structural support column as defined in claim 9, wherein the filament-wound composite of fiber-reinforced bonding agent comprises electrical-grade glass fibers embedded within a low grade polyester system.

15. The structural support column as defined in claim 14 wherein the electrical grade glass fibers comprise an amount within a range of approximately fifty percent to sixty-five percent of the filament-wound composite of fiber-reinforced bonding agent.

* * * * *